United States Patent [19]

Wang

[11] Patent Number: 5,058,412

[45] Date of Patent: Oct. 22, 1991

[54] DRIVING APPARATUS FOR ACTIVATING A WORKPIECE IMPELLING MECHANISM IN A NUT FORMER

[75] Inventor: Sheng-Yau Wang, Tainan City, Taiwan

[73] Assignee: Chun Zu Machinery Industry Co., Ltd., Kaohsiung Hsien, Taiwan

[21] Appl. No.: 513,754

[22] Filed: Apr. 24, 1990

[51] Int. Cl.[5] ..... B21D 45/02; B21D 45/04

[52] U.S. Cl. ..... 72/345; 72/427; 10/11 E

[58] Field of Search ..... 72/344, 345, 346, 427; 10/11 E, 72 T, 12 T, 11 T, 23

[56] References Cited

U.S. PATENT DOCUMENTS

| | | | |
|---|---|---|---|
| 2,139,936 | 12/1938 | Clouse | 10/12 T |
| 3,171,144 | 3/1965 | Maistros | 72/427 |
| 3,238,761 | 3/1966 | Hoyt | 10/23 |
| 3,604,242 | 9/1971 | Allebach et al. | 10/12 T |
| 3,802,014 | 4/1974 | Sieben | 10/23 |
| 3,938,208 | 2/1976 | Lee | 10/11 E |
| 4,296,625 | 10/1981 | Weller et al. | 10/11 E |
| 4,538,437 | 9/1985 | Wisebaker | 72/345 |
| 4,866,970 | 9/1989 | Castiglioni | 10/11 T |

FOREIGN PATENT DOCUMENTS

| | | | |
|---|---|---|---|
| 1305233 | 1/1973 | United Kingdom | 10/11 E |

*Primary Examiner*—Robert L. Spruill
*Attorney, Agent, or Firm*—Ladas & Parry

[57] ABSTRACT

A driving apparatus includes a driving shaft journalled in a nut former, a hollow cylinder having an axially extending bore formed eccentrically therethrough and sleeved rigidly on the driving shaft in such a manner that the driving shaft extends through the bore of the cylinder, a link sleeved removably and rotatably on the cylinder at an end thereof, and a crank having a first crank arm connected pivotally to the other end of the link and a second crank arm connected to a workpiece impelling mechanism. When the driving shaft rotates, the driving apparatus activates the workpiece impelling mechanism.

2 Claims, 7 Drawing Sheets

DRIVING APPARATUS FOR ACTIVATING A WORKPIECE IMPELLING MECHANISM IN A NUT FORMER

BACKGROUND OF THE INVENTION

This invention relates to a nut former, more particularly to a durable driving apparatus for activating a workpiece impelling mechanism in a nut former which has a simplified construction.

Referring to FIG. 1, a nut former includes basically a flywheel (A), a punch unit (B), a die unit (C), a workpiece gripping and conveying unit (D), a feeding unit (E), a cutting unit (F), a workpiece impelling mechanism (G) and a discharge unit (H). In mass production under automatic control, an elongated metal material is moved by the feeding unit (E) to a position in which the metal material is cut off to form a workpiece of a predetermined length to be forged. Then, the workpiece is moved by the workpiece gripping and conveying mechanism (D) to another selected position in which the punch unit (B) forces the workpiece into the die unit (C). Finally, the workpiece impelling mechanism (G) impels the workpiece out of the die unit (C). The workpieces are collected in the discharge unit (H).

Referring to FIG. 2, when a driving shaft (I1) is activated, a driving apparatus (J) rotates the rotating shaft (G1) of the workpiece impelling mechanism (G) in alternate clockwise and counterclockwise directions so as to impel workpieces out of the die unit (C) by the push rods (G2) of the workpiece impelling mechanism (G).

Referring to FIG. 3, a conventional driving apparatus (J) includes a cam member (J1) sleeved rigidly on the driving shaft (I1), and a V-shaped crank (J2) having a first crank arm (J21) carrying a cam follower (J22) thereon, which is arranged in association with the cam member (J1), and a second crank arm (J23) pivoted to the left end of a link (J3). A swing arm (J4) is sleeved rigidly on the rotating shaft (G1) of the workpiece impelling mechanism (G) at the lower end thereof and connected pivotally to the right end of the link (J3). A resilient means (J5) includes a tension spring (J51) secured to the link (J3) by a coupling (J31) at the left end thereof. The right end of the tension spring (J51) is secured to the nut former so as to pull the second crank arm (J23) to the right, thereby maintaining the engagement between the cam member (J1) and the cam follower (J22). As a result, the rotation of the driving shaft (I1) is converted into the reciprocal movement of the push rods (G2). The driving apparatus (J) suffers from the following disadvantages:

(1) When the periphery of the cam member (J1) is severely worn, the cam member (J1) must be replaced so as to ensure the precision of the nut former. It is necessary to remove and mount a large number of elements, such as an equilibrium mechanism or counterweight, during the replacement process of the cam member (J1).

(2) Because the driving apparatus (J) consists of many parts, it is easy to make a great deal of noise in operation.

(3) High-speed mass production of nuts easily causes fatigue of the tension spring (J51). As a result, the cam follower (J22) cannot closely contact the cam member (J1).

(4) Stress easily concentrates on the pivots between the crank (J2), and the link (J3), and between the link (J3) and the swing arm (J4), resulting in deformation of the pivots.

SUMMARY OF THE INVENTION

It is therefore the main object of this invention to provide a curable driving apparatus for a workpiece impelling mechanism in a nut former which has a simplified construction.

According to this invention, a driving apparatus includes a driving shaft journalled in a nut former, a hollow cylinder having an axially extending bore formed eccentrically therethrough and sleeved rigidly on the driving shaft in such a manner that the driving shaft extends through the bore of the cylinder, a link sleeved removably and rotatably on the cylinder at an end thereof, and a crank having a first crank arm connected pivotally to the other end of the link and a second crank arm connected to a workpiece impelling mechanism. When the driving shaft rotates, the driving apparatus activates the workpiece impelling mechanism.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 4:
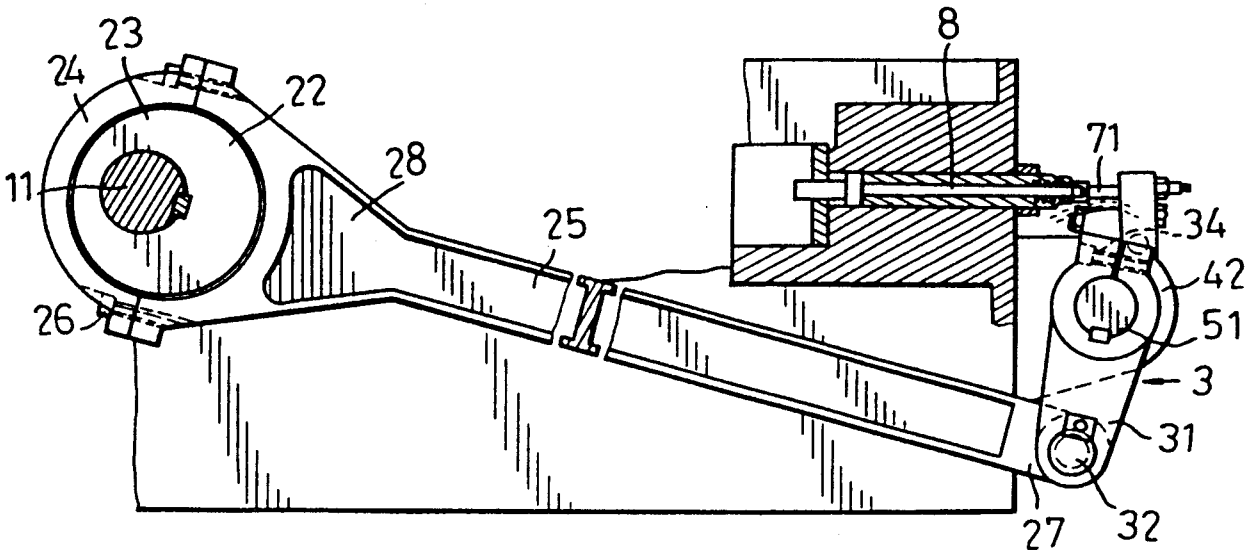
FIG. 4 is a schematic view showing a driving apparatus for activating the workpiece impelling mechanism of a nut former according to this invention.

Referring to FIG. 4, a driving apparatus for a workpiece impelling mechanism in a nut former according to this invention includes a driving shaft 11 journalled on a nut former, and a hollow cylinder 22 having an axially extending bore formed eccentrically therethrough. As illustrated, the cylinder 22 is sleeved rigidly on the driving shaft 11 by a key and keyway arrangement, in such a manner that the driving shaft 11 extends through the bore of the cylinder 22. A retainer 24 with a generally semicircular cross-section is screwed to the left end 28 of a link 25 by bolts 26, so as to define a circular hole therebetween. The cylinder 22 extends through the circular hole defined between the retainer 24 and the link 25. A collar 23 is sleeved on the cylinder 22, so that the left end 28 of the link 25 can rotate relative to the cylinder 22.

Figure 5:
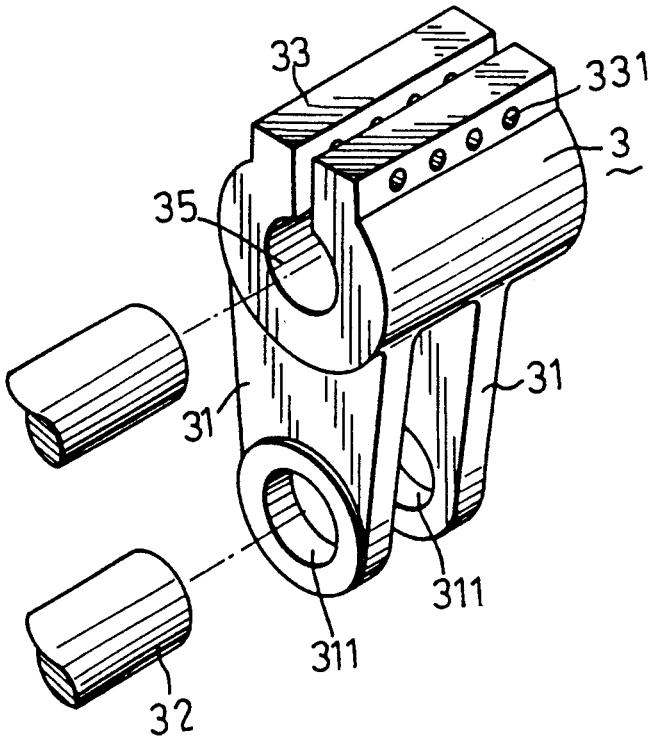
FIG. 5 is a perspective view showing the crank of the driving apparatus according to this invention.
Figure 6:
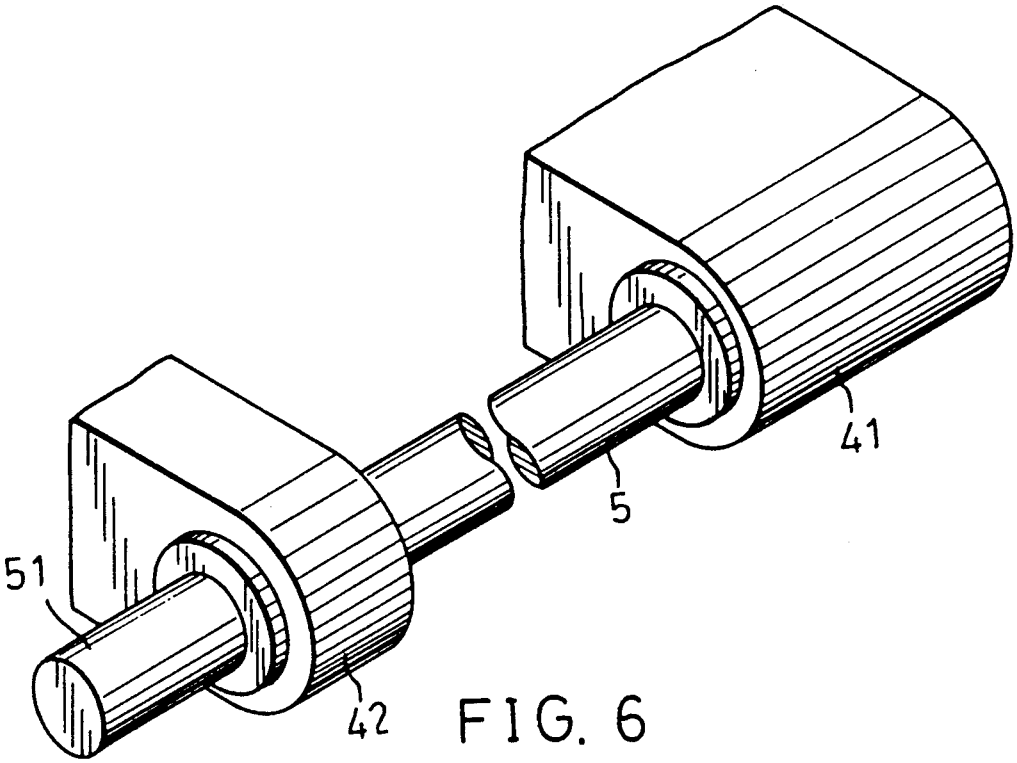
FIG. 6 is a schematic view illustrating how the rotating shaft of the crank of the driving apparatus is journalled on the nut former in accordance with this invention.
Figure 7:
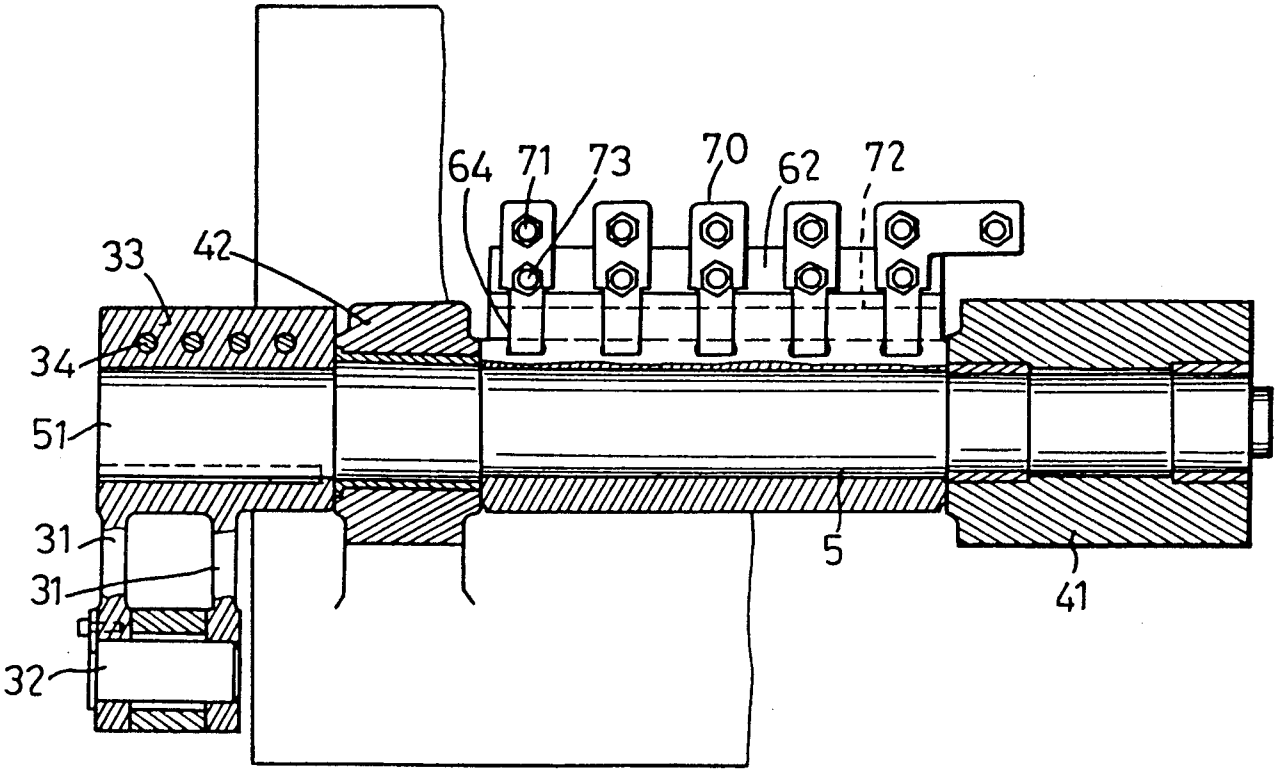
FIG. 7 is a schematic view showing the workpiece impelling mechanism activated by the driving apparatus of this invention.

A crank 3 (see FIG. 5) has two aligned first crank arms 31, each of which has a horizontal hole 311 formed therethrough. A pivot 32 extends through the horizontal holes 311 of the crank 3 and the right end 27 of the link 25, so as to connect pivotally the link 25 to the crank 3. The crank 3 includes two second crank arms 33 at the upper end portion thereof, which have several aligned holes 331. The second crank arms 33 of the crank 3 are joined together by means of fasteners 34 (see FIG. 7), which are disposed within the holes 331 of the second crank arms 33. Therefore, a circular hole 35 is defined between the second crank arms 33, so as to sleeve rotatably the crank 3 on the left end 51 of a rotating shaft 5. The rotating shaft 5 is journalled within two bearing blocks 41, 42 (see FIG. 6) which are fixed on the nut former.

Figure 1:
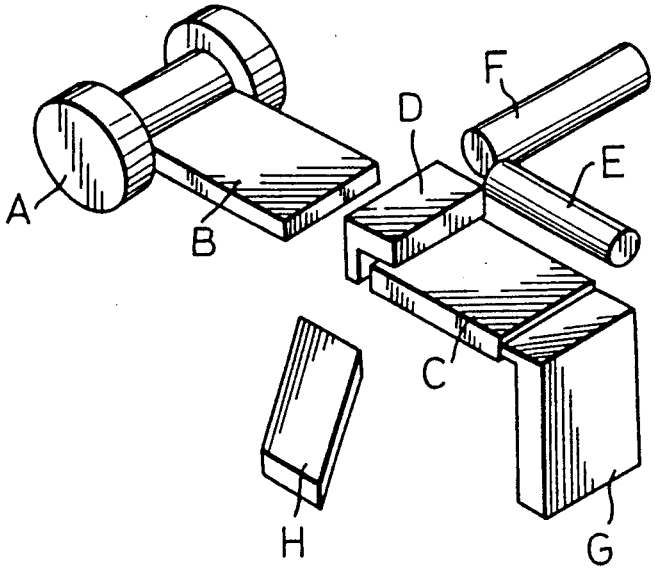
FIG. 1 (PRIOR ART)
FIG. 1 is a schematic view illustrating the primary structure of a conventional nut former.
Figure 8:
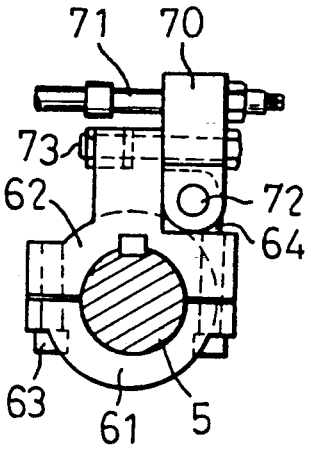
FIG. 8 is a schematic view illustrating how to mount the impelling rods on the workpiece impelling mechanism activated by the driving apparatus of this invention.
Figure 2:
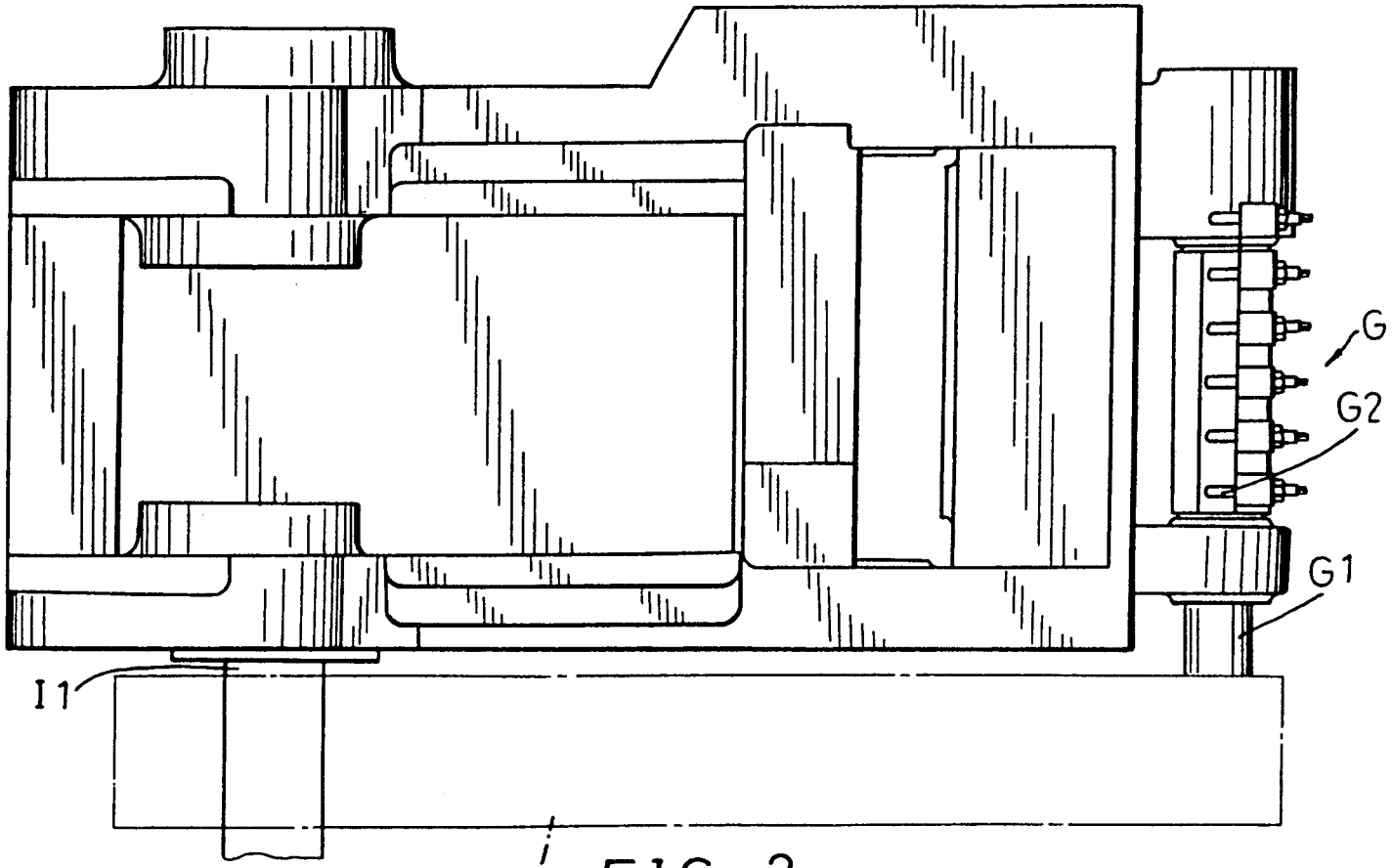
FIG. 2 (PRIOR ART)
FIG. 2 is a schematic view showing the workpiece impelling mechanism of a conventional nut former.
Figure 9:
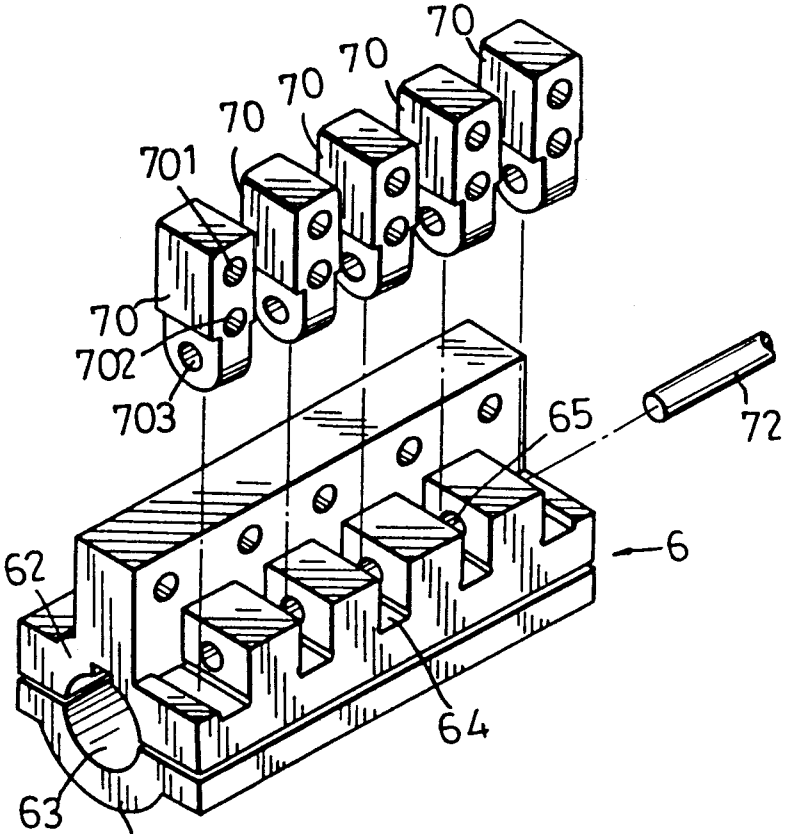
FIG. 9 is a schematic view illustrating the structure of the coupling body of the workpiece impelling mechanism activated by the driving apparatus of this invention.

A coupling body 6 consists of a lower portion 61 and an upper portion 62, between which a circular bore 63 is defined. The lower portion 61 and the upper portion 62 of the coupling body 6 are coupled together by bolts 63 (see FIG. 8), so as to clamp tightly the rotating shaft 5 between the lower portion 61 and the upper portion 62. The upper portion 62 of the coupling body 6 has five aligned rectangular grooves 64, in which the lower portions of five generally T-shaped impelling members 70 are confined. As shown in FIG. 9, each of the impelling members 70 has an upper hole 701, an intermediate hole 702 and a lower hole 703, which are all formed through the impelling member 70. An impelling rod 71 is secured within each of the upper holes 701 of the impelling member 70, so as to impel a workpiece out of a die. A pivot rod 72 extends through the lower holes 703 of the impelling member 70 and the positioning holes 65 in the upper portion 62 of the coupling body 6. A safety element or bolt 73 locks each of the impelling members 70 on the coupling body 6, so as to prevent the rotation of the impelling member 70 relative to the pivot rod 72. In a case where the impelling force of the impelling rod 71 is insufficient to impel a workpiece in a die, the safety element 73 is broken. This breaking of the safety element 73 prevents other parts of the nut former from damage.

When the driving shaft 11 rotates, the crank 3 swings. The swinging movement of the crank 3 is transferred to the impelling rods 71, so as to reciprocate the push rods 8 of the workpiece impelling mechanism.

Figure 3:
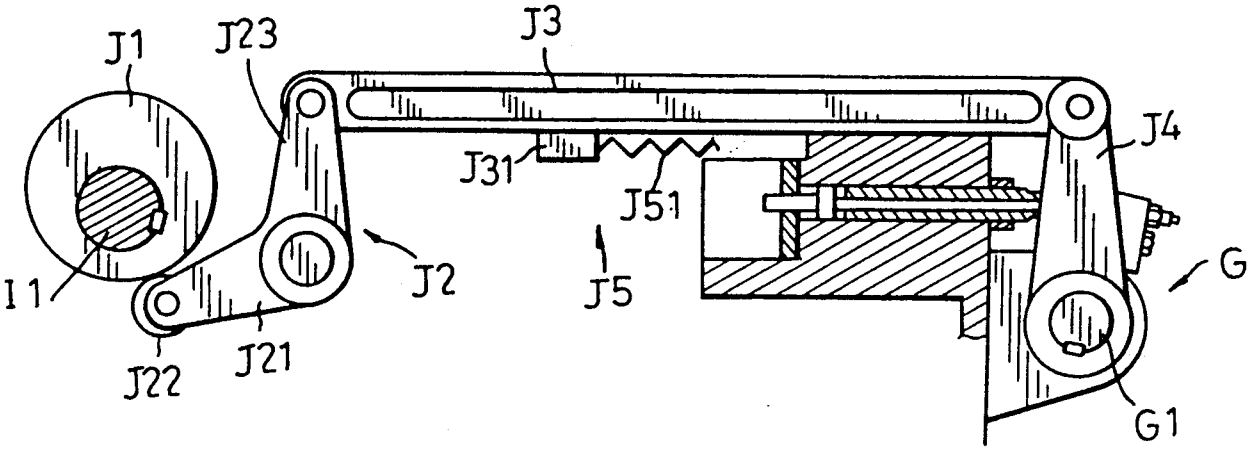
FIG. 3 (PRIOR ART)
FIG. 3 is a schematic view showing a driving apparatus for activating the workpiece impelling mechanism of a conventional nut former.

It can be appreciated that the structure of the driving apparatus of this invention is simpler than that of the conventional apparatus shown in FIG. 3.

When the driving apparatus of this invention is used for a long period and the collar 23 is severely worn and needs to be replaced, it is necessary to only remove and mount the retainer 24. This displacement process is easier to perform than that of the conventional apparatus shown in FIG. 3.

The interengaging surface between the link 25 and the cylinder 22 is much greater than that between the cam member (J1) and the cam follower (J22) of the conventional apparatus shown in FIG. 3. The concentration of stress is eliminated.

With this invention thus explained, it is apparent that numerous modifications and variations can be made without departing from the scope and spirit of this invention. It is therefore intended that this invention be limited only as indicated in the appended claims.

I claim:

1. A nut former comprising:

(a) a driving shaft journaled in the nut former;

(b) a hollow cylinder having an axially extending bore formed eccentrically therethrough and sleeved rigidly on the driving shaft such that the driving shaft extends through the bore of the cylinder.

(c) a link, one end of which is removably and rotatably sleeved on the cylinder;

(d) a rotating shaft journaled in the nut former;

(e) a crank having a first crank arm connected pivotally to the other end of the link and a second crank arm sleeved rigidly on the rotating shaft;

(f) a coupling body sleeved rigidly on the rotating shaft;

(g) an impelling rod secured to the coupling body;

(h) a die fixed on the nut former;

(i) a push rod connected to the impelling rod and having an end extending into the die so as to impel a workpiece out of the die along a straight path; whereby, when the driving shaft rotates, swinging movement of the crank is transferred to the impelling rod through the rotating shaft and the coupling body so as to reciprocate the push rod.

2. A nut former in claim 1, wherein the coupling body includes:

(a) an impelling member having a lower end connected pivotally to the coupling body and an upper end secured to the impelling rod and;

(b) a safety element connecting threadably the impelling member to the coupling body so as to prevent rotation of the impelling member to coupling body; whereby, where impelling force of the impelling rod is insufficient to impel a workpiece in the die, the safety element is broken, thereby preventing damage to other parts of the nut former.

* * * * *